United States Patent [19]

Bulso, Jr. et al.

[11] Patent Number: 4,587,826

[45] **Date of Patent: * May 13, 1986**

[54] CONTAINER END PANEL FORMING METHOD AND APPARATUS

[75] Inventors: Joseph D. Bulso, Jr., Canton; James A. McClung, North Canton, both of Ohio

[73] Assignee: Redicon Corporation, Canton, Ohio

[ * ] Notice: The portion of the term of this patent subsequent to May 13, 2003 has been disclaimed.

[21] Appl. No.: 605,888

[22] Filed: May 1, 1984

[51] Int. Cl.[4] ..... B21D 22/00; B21D 28/02

[52] U.S. Cl. ..... 72/329; 72/336; 72/339; 72/347; 72/348; 72/350; 413/56

[58] Field of Search ..... 72/329, 336, 339, 347, 72/348, 349, 350, 351; 413/56

[56] References Cited

U.S. PATENT DOCUMENTS

| | | | |
|---|---|---|---|
| 3,236,088 | 2/1966 | Moller | 72/351 X |
| 3,537,291 | 11/1970 | Hawkins | 72/336 |
| 3,695,084 | 10/1972 | Siemonsen et al. | 72/348 |
| 3,902,347 | 9/1975 | Ridgway | 72/336 |
| 4,031,837 | 6/1977 | Jordan | 413/8 |
| 4,051,707 | 10/1977 | Valek et al. | 72/348 |
| 4,093,102 | 6/1978 | Kraska | 220/67 |
| 4,119,050 | 10/1978 | Klein | 413/13 |
| 4,183,445 | 1/1980 | LaCross | 220/273 |
| 4,192,244 | 3/1980 | Kelley et al. | 413/17 |
| 4,213,324 | 7/1980 | Kelley et al. | 72/405 |
| 4,215,795 | 8/1980 | Elser | 220/276 |
| 4,244,315 | 1/1981 | Klein | 413/17 |
| 4,291,567 | 9/1981 | Murayama | 72/347 |
| 4,305,523 | 12/1981 | Dalli et al. | 220/268 |
| 4,345,696 | 8/1982 | Guimarin | 220/277 |
| 4,348,464 | 9/1982 | Khoury | 428/571 |
| 4,414,836 | 11/1983 | Saunders | 72/348 X |

FOREIGN PATENT DOCUMENTS

| | | | |
|---|---|---|---|
| 0061756 | 10/1948 | Netherlands | 72/347 |

*Primary Examiner*—Francis S. Husar
*Assistant Examiner*—Steve Katz
*Attorney, Agent, or Firm*—Reese Taylor

[57] ABSTRACT

A method and apparatus for forming end panels of uniform thickness for use with two-piece containers. The method includes the steps of engaging the stock under fluid pressure and blanking it; wiping the periphery of the stock against the blanking die to form a lip extending in a direction substantially normal to the planar surface of the blank. While still maintaining pressure on the blank, further steps involve drawing the blank to form an edge area that extends above the top planar surface of the blank and has a cross-sectional configuration resembling an inverted letter J, and finally completing forming of the end panel by reverse drawing the central body portion of the blank in an upward direction to set a chuckwall between the central body portion and the edge area. The apparatus includes tooling for a double action shell press which is capable of engaging and holding down the work piece under fluid pressure while performing the blanking and drawing operations. The apparatus also includes profiling and reverse draw tooling carried by the bottom bolster of the press so that the contours or configurations of the end panel are formed from both sides, thereby avoiding, in the final forming operation, a reduction in the wall thickness and enabling a significant reduction in the base weight of the starting metal.

7 Claims, 11 Drawing Figures

CONTAINER END PANEL FORMING METHOD AND APPARATUS

RELATED PATENT APPLICATIONS

This application is related to copending application Ser. No. 605,920 filled May 1, 1984 by the same inventors and entitled Shell Reforming Method and Apparatus.

FIELD OF THE INVENTION

The invention relates, in general, to forming container end panels or shells for closing the ends of two-piece containers and relates, in particular, to a unique method of employing a double action press with a "third" action to form the contours of the end panel in the chuckwall area so that a sharper radius can be formed without any significant reduction of the metal thickness in the radiused areas. The invention can be used to "reform" a partially formed shell to tighten up the radius or to completely form the shell from flat metal stock.

DECRIPTION OF THE PRIOR ART

Metal containers or cans are well known in the art with these containers primarily being used for food and beverages but, of course, having application for other products as well. Currently, the most common containers of this general nature are of the "two-piece" variety consisting of a unitary container body and a container end panel or shell which is affixed to the open end of the can body after the contents have been supplied. Both components are commonly drawn and redrawn from flat metal stock.

Various end panels and conventional methods and apparatus for their forming can be seen in many U.S. patents, such as, Khoury U.S. Pat. No. 4,348,464; Guimarin U.S. Pat. No. 4,345,696; Dalli et al U.S. Pat. No. 4,305,523; Murayama U.S. Pat. No. 4,291,567; Klein U.S. Pat. No. 4,244,315; Elser U.S. Pat. No. 4,215,795; Kelley et al U.S. Pat. No. 4,213,324; Kelley et al U.S. Pat. No. 4,192,244; LaCross U.S. Pat. No. 4,183,445; Klein U.S. Pat. No. 4,119,050; Kraska U.S. Pat. No. 4,093,102; and Jordan U.S. Pat. No. 4,031,837. This art is representative of various approaches to shell forming.

In many applications, the contents of the container are packed under pressure. For example, a typical beverage container must be capable of withstanding about 90 p.s.i. without buckling. Buckling occurs when at least a portion of the chuckwall of the end panel is pulled upwardly and inwardly away from its connection with the can body in response to the internal pressures. Such an occurence will obviously ruin the contents. Therefore, the thinnest portion of the two pieces of the container must be of sufficient thickness to withstand the maximum internal pressure.

Heretofore, the primary source of difficulty in this regard has been with the container end panel which is formed with various contours so that it can be joined to the top of the cylindrical container by the usual curling and seaming process and with these contours including various radiused areas. Generally, difficulties have been encountered because of the fact that during the drawing operation these radiused areas tend to thin out as the metal is drawn and stretched. With the known methods and apparatus for forming container ends, it has been found necessary to compensate in advance for this phenomenon by utilizing a heavier gauge metal than would otherwise be required to provide sufficient thickness in the finished product to withstand the internal pressures.

Stated otherwise, because of the fact that the radiused areas do thin to a greater degree than the remaining portions of the end panel, the result is that the remaining portions of the end product are really thicker than would otherwise be required. In effect, it is necessary to over-compensate with a consequent waste of material.

It has, however, been discovered that this difficulty can be overcome by providing a method and apparatus in which the work piece is attached from both sides, i.e., wherein a "reverse" draw is employed to finally form the chuckwall. In this fashion, since the metal is not really being formed against a die and there is no stretching in the final step of the operation, the radiuses are not thinned out and it is possible to initially employ a lighter metal or to reduce the base weight of the starting metal.

While, of course, the material savings with any individual container are minute, when multiplied by the thousands and even millions of containers a conventional container forming plant will produce, these savings are quite significant.

SUMMARY OF THE INVENTION

It has been found that the aforementioned difficulties, namely the thinning of the material of the container end panel in the radiused areas thereof, can effectively be overcome by providing apparatus and a method of utilizing that apparatus in which the final contouring of the container end can be accomplished without any stretching and thereby without any thinning of the metal.

It has been discovered that this can be accomplished by providing a method of forming in which the metal is effectively rolled backward into itself without the influence of any dies. Effectively, the operation involves utilizing a double action press to initially form the container end panel with a punch and die and then employing a third, profiling action from the bottom which effectively does roll the metal back onto itself. Such motion may be likened to attempting to turn the container end panel inside out. This not only avoids thinning in the radiused areas but produces almost a double thickness in that area. It also enables a significant reduction in the base weight of the metal employed in the container end panel.

Accordingly, production of an improved method and apparatus for carrying out the method of forming a container end for a two-piece container becomes the principal object of this invention with other objects thereof becoming more apparent upon a reading of the following brief specification considered and interpreted in view of the accompanying drawings.

OF THE DRAWINGS

DECRIPTION OF THE PREFERRED EMBODIMENTS

Figure 1:
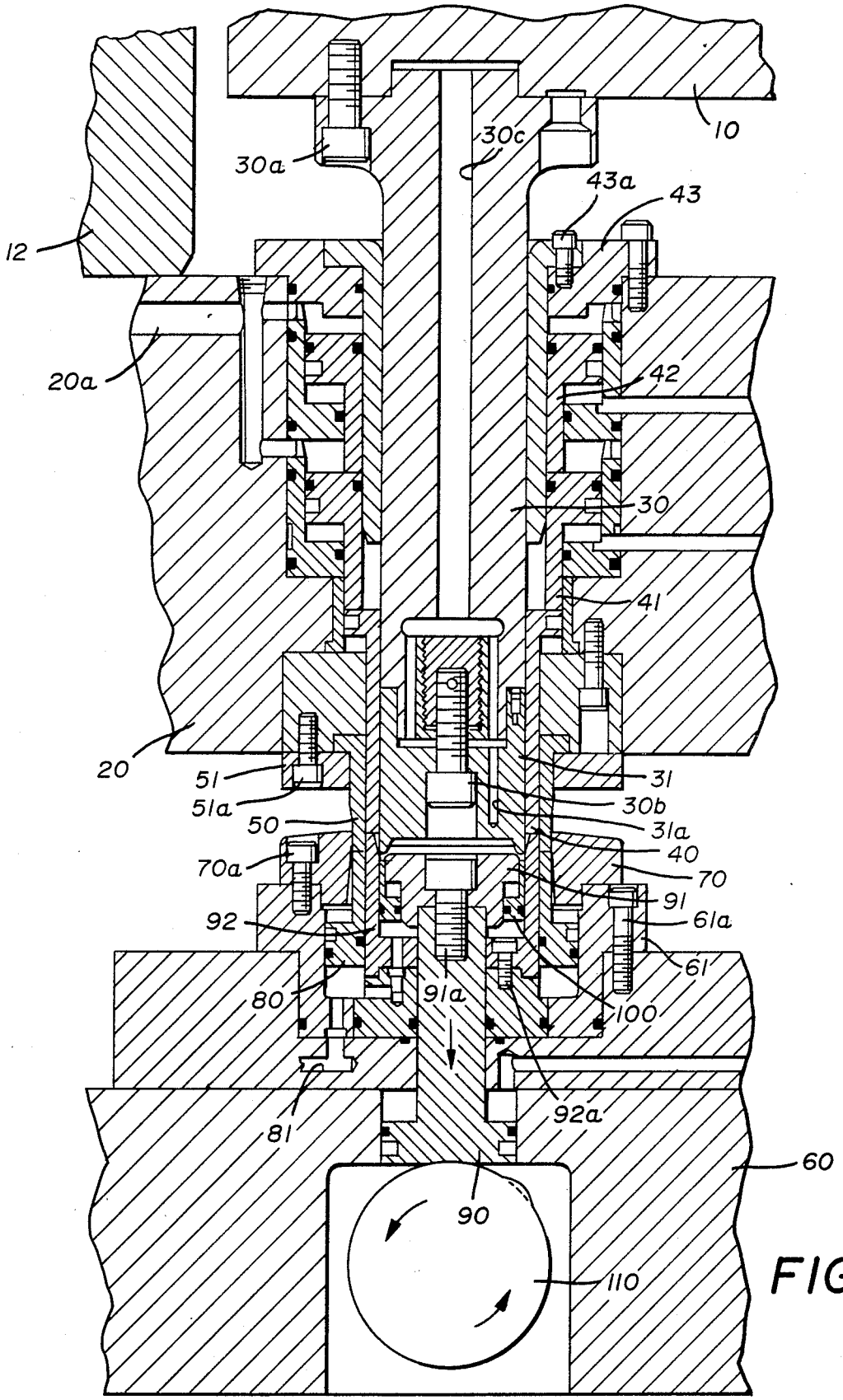
FIG. 1 is an elevational view, in section, showing the forming apparatus at its beginning position.

As noted above, the apparatus of the present invention is intended to be utilized in a double action press and, to that end, FIG. 1 of the drawings illustrates an inner ram 10 and an outer ram 12. The press has not been described in great detail since such presses, as exemplified in Ridgway U.S. Pat. No. 3,902,347, are well known in this art.

Still referring to FIG. 1 wherein the tooling is illustrated in the bottom, dead center position (see also FIG. 3), it will be noted that the outer ram 12 carries an outer ram punch holder 20 and the inner ram 10 carries a punch center post 30, secured thereto by screws 30*a*. The punch holders and their associated components will thus move with the inner and outer rams as the press opens and closes, as will become more apparent.

Still referring to FIG. 1 for a more detailed description of the apparatus carried by the inner ram punch center post 30, it will be noted that a punch core 31 is secured to the distal end of punch center post 30 by screw 30*b*.

In this fashion, the punch center post 30 and the punch core 31 are movable together with the inner ram 10, as will be described in greater detail below.

Punch center post 30 also has a through passage 30*c* which is in fluid contact with a supply source (not shown) and in fluid communication with a similar passage 31*a* in the punch core 31. This arrangement permits air to be used to eject the formed end panels, if necessary, as shown and explained in Bulso U.S. Pat. No. 4,343,173.

Referring still to FIG. 1, the outer ram 12, which carries the outer punch holder 20, has a through central bore which permits, among other things, the reciprocal movement of the punch center post 30 and the punch core 31 so that these elements may pass through the central bore of the outer ram punch holder 20 and operate independently thereof.

Also received within this central bore is a pressure sleeve 40. The pressure sleeve 40 is freely movable in response to pneumatic pressure and is also acted upon by a pair of stacked pistons. Thus, the first piston 41 is disposed in the upper cylinder immediately above the pressure sleeve 40 and the second piston 42 is disposed immediately above the first piston 41. These pistons are actuated by a source of pneumatic or hydraulic pressure passing through the bore 20*a*, as will be described in greater detail below. Completing the chamber, within which the first and second pistons 41 and 42 operate, is a cap sleeve 43 which is firmly secured to the outer punch holder 20 by means of screws such as 43*a*.

Disposed adjacent the bottom or distal end of the outer ram punch holder 20 is a punch shell 50 which is secured to the bottom of the punch holder 30 by a retainer 51 and suitable screws such as 51*a*.

It will be noted that the means and apparatus for providing the pressure to activate the pressure sleeve 40 are not illustrated in great detail since their structure and method of operation are believed to be within the knowledge and capability of one with ordinary skill in this art.

Still referring to FIG. 1, reference is now had to the lower portion thereof wherein the bottom bolster or die support 60 is illustrated as being disposed in opposed relationship with the inner and outer rams and the tooling associated therewith.

Secured to the disc support 60 is a support ring 61 which is attached thereto by suitable screws 61*a* (only one shown). This die support ring 61 carries, on its upper edge, a blank cut edge 70 which is secured thereto by means of the suitable screws such as 70*a*.

A second pressure sleeve 80 is received within the central portion of the die support 60 and is actuated by pneumatic pressure through the passage 81 in die support 60 and is normally urged to the up position. Of course, since FIG. 1 illustrates the tooling in the bottom, dead center position, sleeve 80 is in the "down" position, as will be explained more fully below.

Received still futher internally and concentrically inwardly of the pressure sleeve 80 is the die core ring 92 which is fixed to die support 60 by screws 92*a*.

Still further inwardly and concentrically mounted is a knockout member 100 which is also fluid actuated and still further inwardly is a die core riser 90 and a die core and profile pad 91 fixed thereto by screw 91*a*.

Die core riser 90 rests on cam 110 which is driven off the main crank of the press and which controls movement of the riser and the profile pad, as will be described.

It will be understood here that the apparatus just described is the tooling necessary to form one container end panel per press cycle and that a typical press would carry a multiplicity of identical sets so as to permit formation of a plurality of end panels per cycle.

Figure 2:
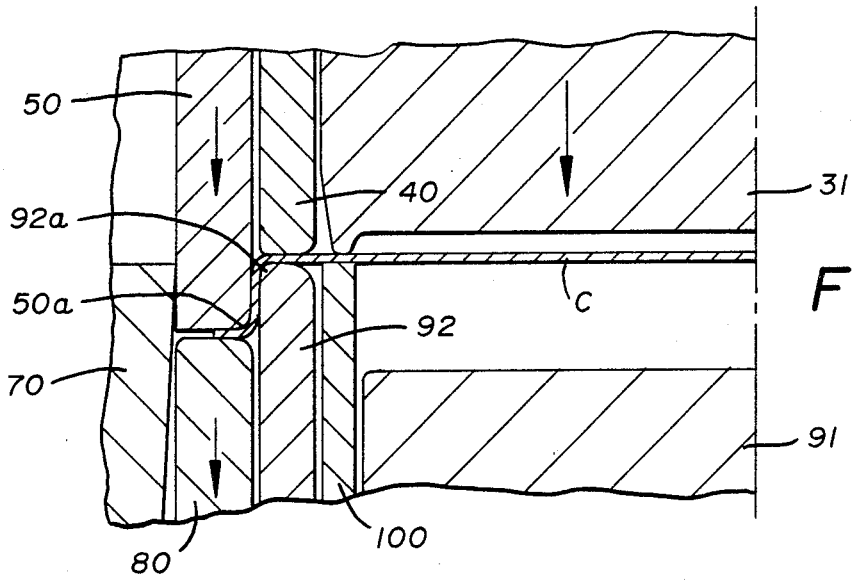
FIG. 2 through 9 are partially schematic, elevational views showing the various positions of the apparatus during the various stages of the forming operation.

Turning then to FIGS. 2 through 10 for a description of the operation of the apparatus and tooling of the present invention illustrated in FIG. 1, it will first be assumed that, as illustrated in FIG. 2, the blanking operation has been completed by downward movement of punch shell 50 in cooperation with the blank cut edge 70.

FIG. 2 illustrates the formation of a reverse cup C following the blanking operation. In this figure, the punch core 31 and the punch shell 50 are moved downwardly as indicated by the arrows in the drawing and as shown by the timing diagram of FIG. 11. At this point, the first pressure sleeve 40, under pressure through bore 20*a* on pistons 41 and 42, will be holding the metal against the die core ring 92 which is supported by fluid pressure. Downward movement of the punch shell 50 will pull the material over the radius 92*a* of the fixed die core ring 92 and radius 50*a* of punch shell 50 with it being understood that the peripheral edge is held between punch shell 50 and second pressure sleeve 80. This will result in formation of the "reverse" cup C illustrated in FIG. 2.

Figure 3:
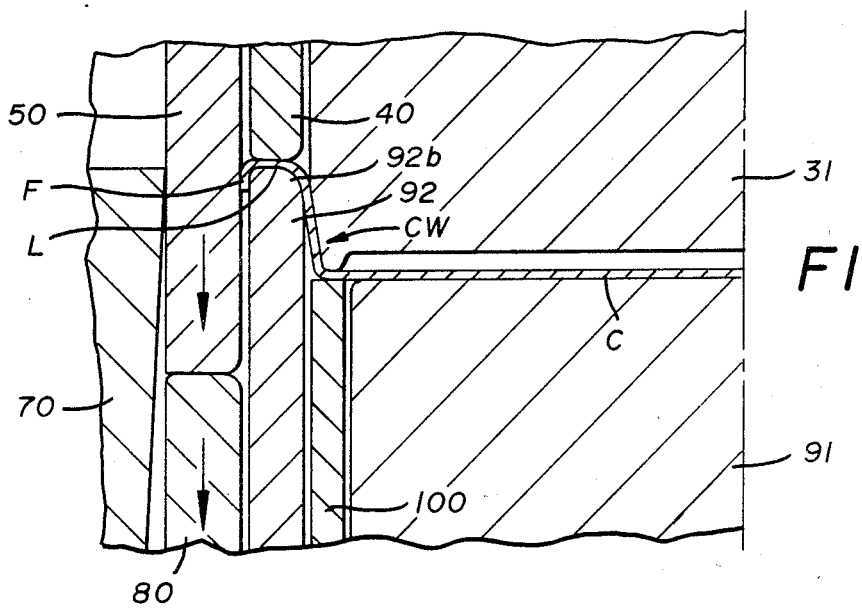

In FIG. 3, punch core 31 continues its downward movement drawing the lip L and establishing the chuckwall area CW. The punch shell 50, it will be noted, continues downwardly forcing second pressure sleeve 80 in a downward direction setting the lip height of the seaming panel. Also, knockout member 100 is forced down by the punch core 31 and the flange F is really drawn around radius 92*b* to form the chuckwall. It should be noted that the chuckwall CW is "over length" at this point for purposes which will be described below. In effect, the shell or end panel is overdrawn at this point.

Figure 4:
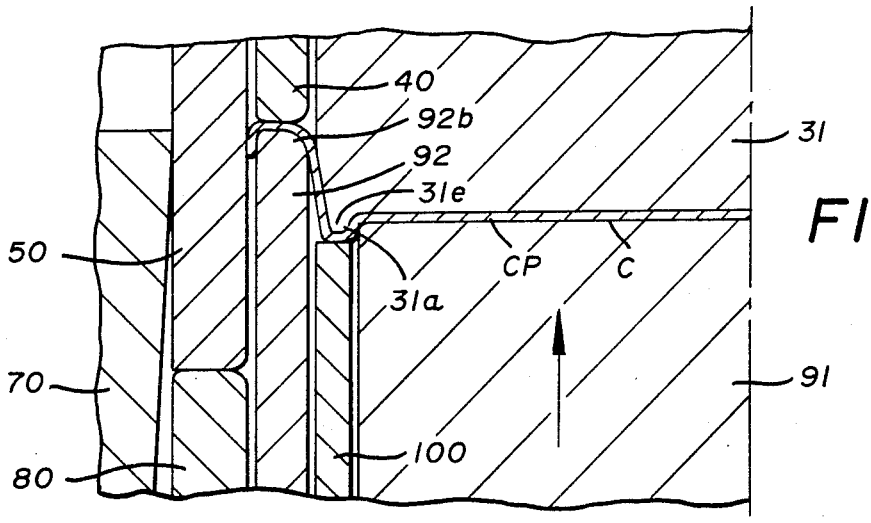

Turning to FIG. 4 then, it will be seen that the punch shell 50 and second pressure sleeve 80 have ceased moving in a downward direction. This results in little or no holding pressure or tension on the metal between die core ring 92 and first pressure sleeve 40 so that the material in chuckwall CW can be pulled around radius 92*b* to form the end panel. This avoids the problem often encountered with a conventional draw around a sharp radius with firm holding pressure. As can be seen, profile pad 91 is actually pushing up against the material which pulls the excess material from the chuckwall area CW into the center panel area CP.

At this point, profile pad 91 starts its upward movement and pushes the material about projection 31*e* to shorten the chuckwall CW and form radius 31*a*. This movement of pad 91 is caused by cam 110 (see FIG. 10). Effectively at this point then, the length of the chuckwall CW is shortened to its final dimension and the material which is pulled, as noted, around the radius 92*b* of die core ring 92 and radius 31*a* on the punch core 31, actually forms the central panel CP of the shell and sets the annular reinforcement groove G.

It should be noted here that punch core 31 never truly bottoms out on die core 91. Thus, if a double shell is encountered, as often happens, the tooling will be protected from damage.

Figure 5:
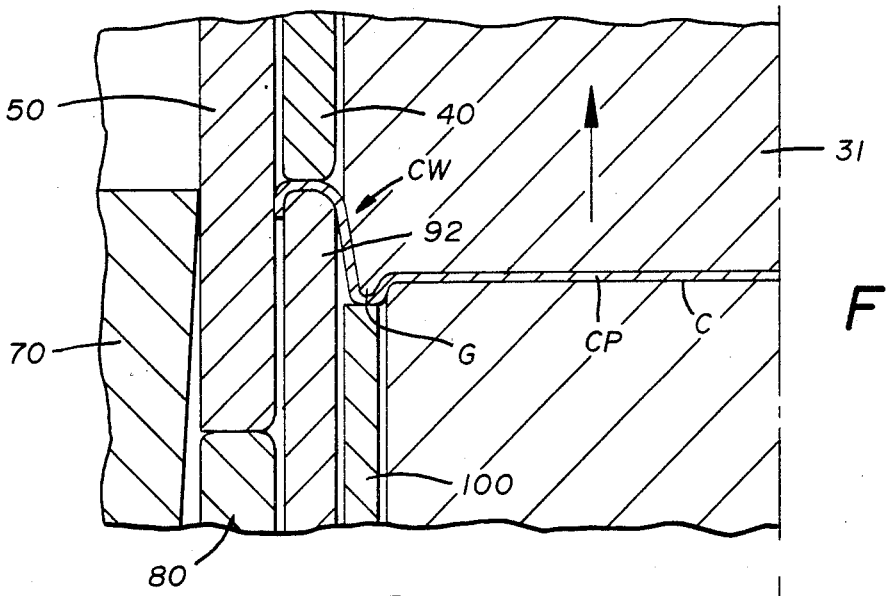
Figure 11:
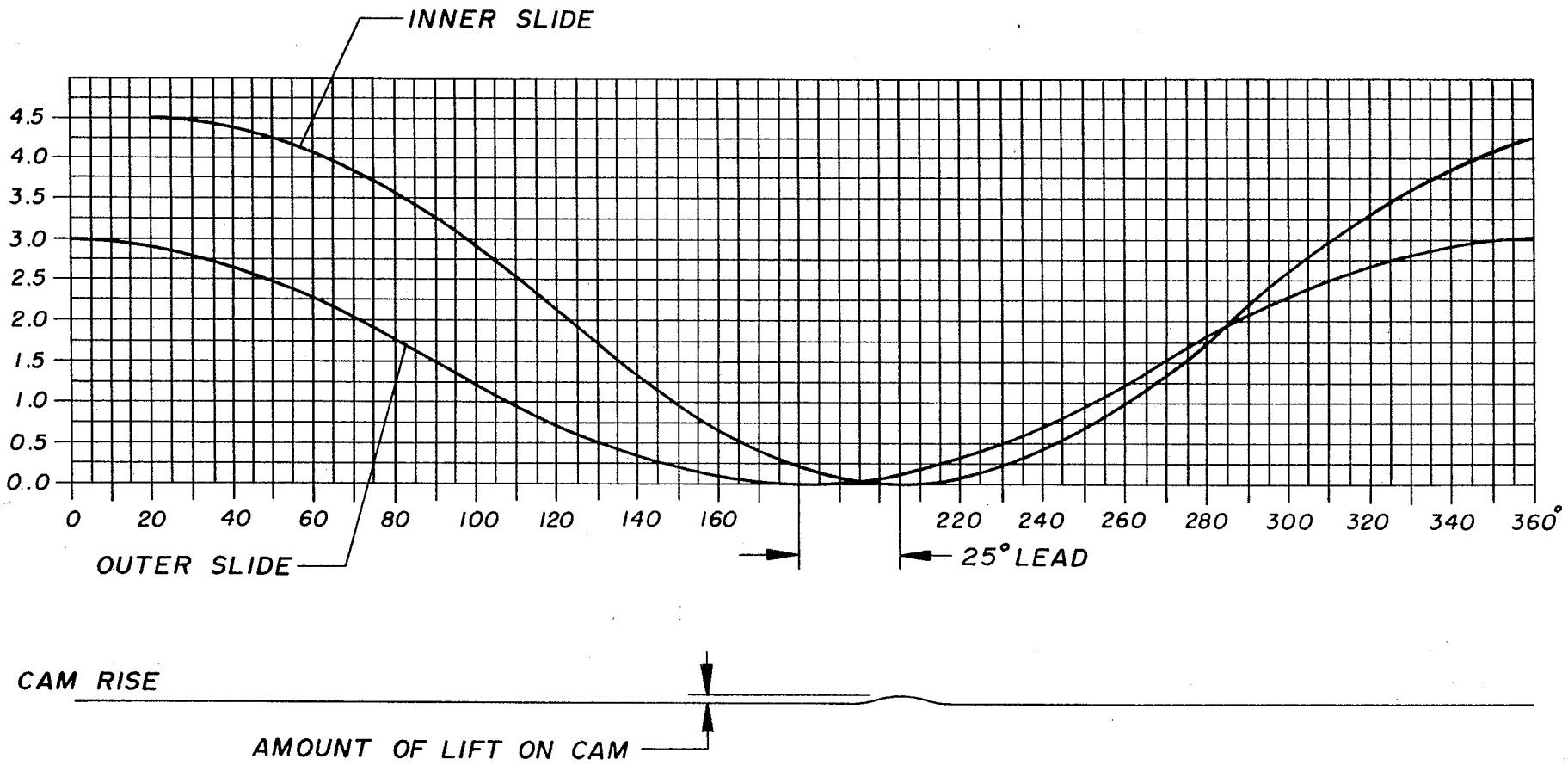
FIG. 11 is a cycle chart illustrating positions of the apparatus throughout a complete 360° cycle of operation.

Referring to FIG. 5, it will be noted that the punch shell 50 and the second pressure sleeve 80 are, in this figure of the drawings, at bottom, dead center while the punch core 31 has started its upward movement along with inner ram 10 (see FIG 11).

Figure 6:
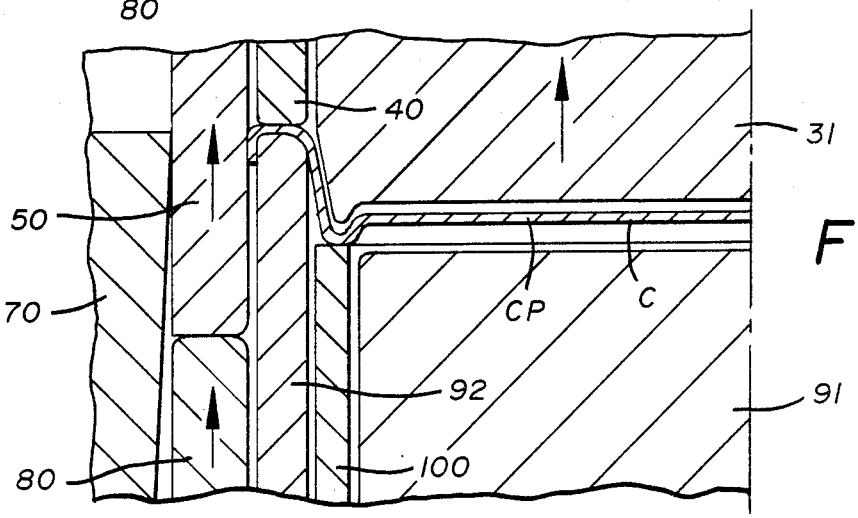

FIG. 6 illustrates the position of the tooling when the outer punch holder 20 has started up and it will be noted that retraction of the punch core 31 has begun. Also, the second pressure sleeve 80 and punch shell 50, have started up since the sleeve is no longer held down by punch shell 50. At the same time, the knockout ring 100 also has started its upward movement under fluid pressure since it is no longer held down by punch core 31.

Figure 7:
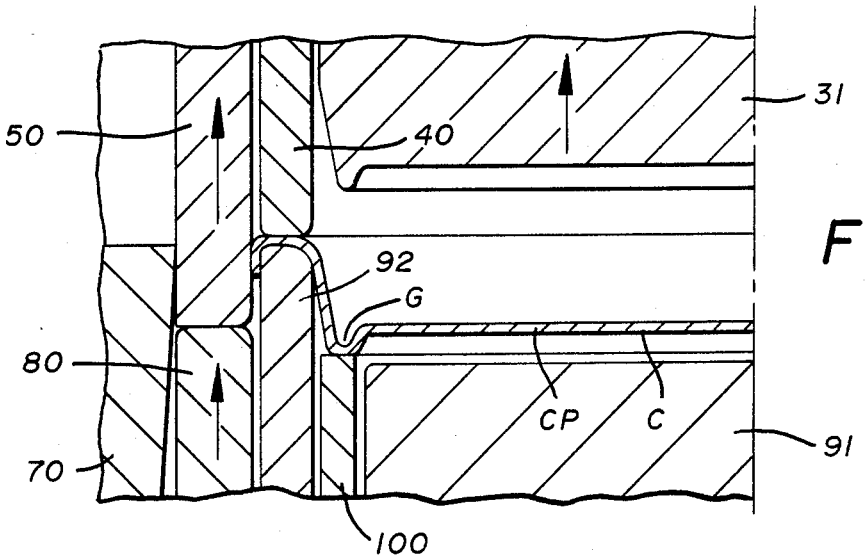
Figure 8:
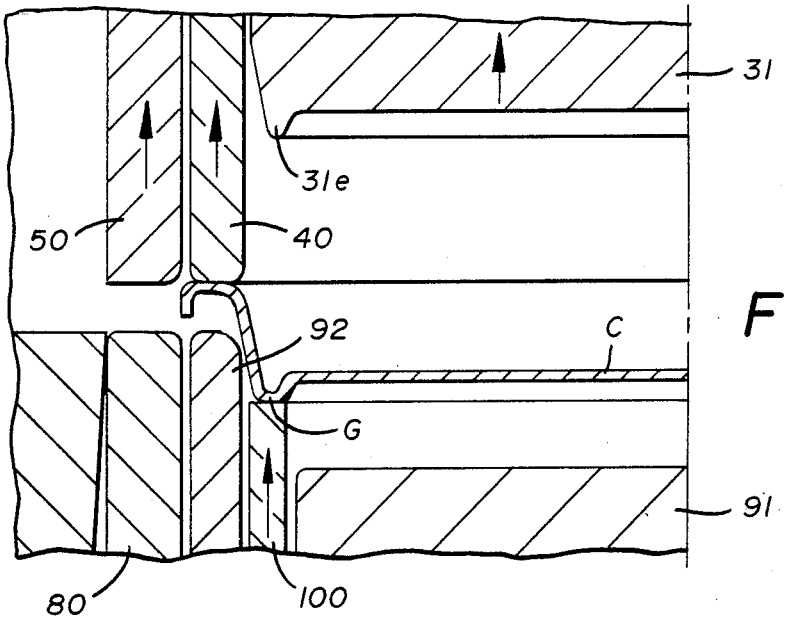

FIGS. 7 and 8 show further progression of the upward movement with it being understood that at this point both the inner and outer rams and their associated punch holders are continuing to move upwardly with the knockout ring 100 also continuing in an upward direction, as illustrated by the arrows in the drawings.

Figure 9:
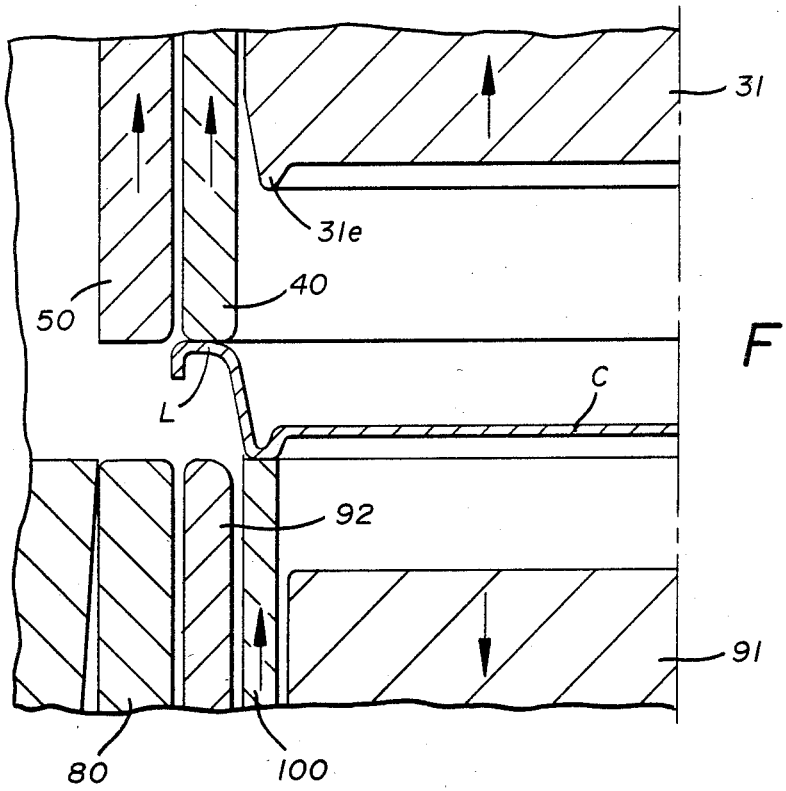
Figure 10:
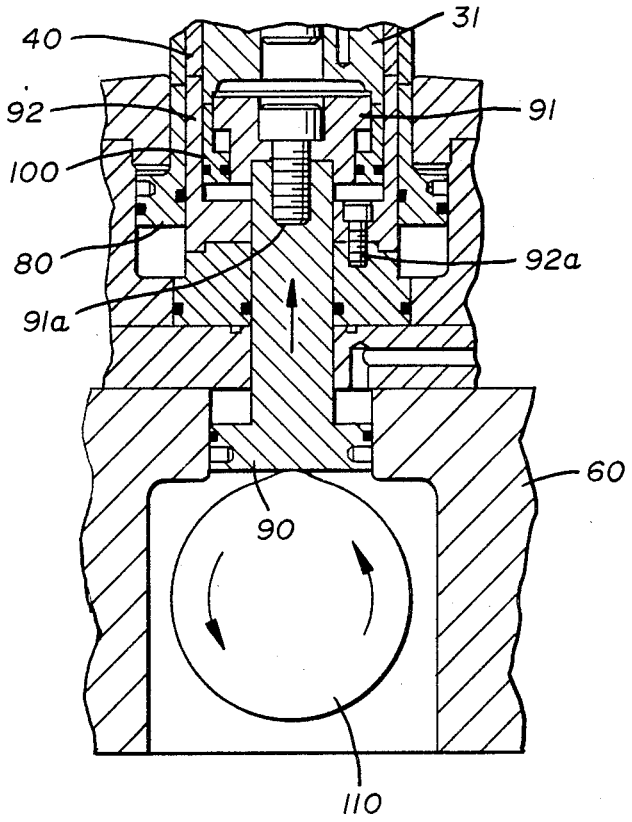
FIG. 10 is a partial elevation showing the tooling at the FIG. 4 position.

FIG. 9 shows the complete open position of the tooling with the punch core 31 and the first pressure sleeve 40 and punch shell 50 being lifted completely out of the way, sufficient, at least, for the shell C to be lifted above the die line by the knockout ring 100 for removal from the press or transfer to the next station.

It should be apparent from the foregoing that the height of the lip L is set initially at the stage of the operation illustrated in FIG. 3 and does not change and is not disturbed during the subsequent operations. It is important to note, however, as already mentioned, that the length of the chuckwall CW initially set in FIG. 3 is slightly longer than its final dimension. This makes it possible to accumulate additional material in that area and, as already noted, that material is actually pulled down into the center panel CP to form that panel. The result, however, is that the final thickness in the chuckwall area is maintained to the desired specifications and is not, in fact, thinned out as would be the case if that area were subject to a drawing operation at that point.

It should also be noted that this type of operation avoids coining of the lip L. By pulling rather than drawing the material in the chuckwall area, it is possible to apply much lighter pressure on the lip L at the critical point. This avoids any marking or coining of the lip which is important because if the lip is coined or marked, it is subject to cracking during the subsequent seaming operation.

It will also be apparent that the radius of the annular groove G can be as tight as described. While there is some limit as to how tight a radius can be achieved in a drawing operation, there is virtually no limitation on the sharpness of the radius in this area with a shell formed in this fashion. As a matter of fact, the radius could be so severe that the opposite sides of the metal which form the groove G could be in metal to metal contact if desired and required for the particular application intended for the shell thus formed.

While a full and complete description of the invention has been set forth in accordance with the dictates of the Patent Statutes, it should be understood that modifications can be resorted to without departing from the spirit hereof or the scope of the appended claims.

What is claimed is:

1. A method of forming a container end panel from a flat sheet of material comprising the steps of:

(a) blanking and drawing a reverse cup while holding the peripheral edge under pressure;

(b) drawing the lip of the end panel and establishing an overlength chuckwall; and (c) releasing holding pressure on the peripheral edge and pulling material from the chuckwall into the central panel while simultaneously setting the chuckwall radius by pushing the central panel upwardly.

2. The method of claim 1 wherein said holding pressure is supplied by fluid actuated pressure in cooperation with a fixed die core ring.

3. The method of claim 1 wherein said central panel is pushed upwardly by a cam actuated die core.

4. In a double acting press having inner and outer rams and an opposed platen and apparatus for forming the end panel of a container from a sheet of material, the improvement comprising:

(a) a punch core carried by the inner ram and a die core arranged in opposed relationship therewith;

(b) first pressure means carried by the outer ram and a die corcore ring arranged in opposed relationship therewith;

(c) said first pressure means normally holding the end panel against said die core ring during movement of the outer ram toward the fixed platen;

(d) said first pressure means terminating movement toward said die core ring and relieving holding pressure on said end panel upon termination of movement of the outer ram toward the fixed platen; and (e) means carried by the fixed platen for moving said die core toward said punch core as the inner ram and said punch core move away from the platen upon relief of holding pressure.

5. The apparatus of claim 4 wherein said means for moving said die core includes a cam actuated assembly carried by the fixed platen.

6. In a double acting press having movable inner and outer rams and a fixed platen and apparatus for forming the end panel of a container from a sheet of material, the improvement comprising:

(a) a punch core carried by the inner ram;

(b) a die core movably mounted on the fixed platen in opposed relationship with said punch core;

(c) a first pressure sleeve system carried by the outer ram;

(d) a die core ring supported on said fixed platen in opposed relationship with said first pressure sleeve system;

(e) a punch shell carried on the inner ram;

(f) second pressure sleeve means carried on the fixed platen in opposed relationship with said punch shell;

(g) a fluid operated knockout piston carried by the fixed platen in opposed relationship with said punch core and encircling relationship with said die core;

(h) said first pressure sleeve system holding the material against said die core ring under fluid pressure during movement of the outer ram toward the fixed platen;

(i) said punch core drawing the material over said die core ring upon movement of said outer ram toward said fixed platen to form an over length chuckwall;

(j) said punch core being movable away from the fixed platen; and (k) means carried by the fixed platen for moving said die core toward said punch core upon movement of said punch core away from said fixed platen.

7. The apparatus of claim 6 wherein said last mentioned means includes a cam assembly.

* * * * *